US007955058B1

(12) United States Patent
Angel

(10) Patent No.: US 7,955,058 B1
(45) Date of Patent: Jun. 7, 2011

(54) RECIPROCATING PISTON TO PISTON ENERGY PUMP

(76) Inventor: Wayne Michael Angel, Paradise, CA (US)

( * ) Notice: Subject to any disclaimer, the term of this patent is extended or adjusted under 35 U.S.C. 154(b) by 0 days.

(21) Appl. No.: 12/804,119

(22) Filed: Jul. 13, 2010

(51) Int. Cl.
*F04B 17/00* (2006.01)

(52) U.S. Cl. ..... 417/397; 417/396; 417/237

(58) Field of Classification Search ..... 417/236–238, 417/396, 397; 91/341 R, 342, 303
See application file for complete search history.

(56) References Cited

U.S. PATENT DOCUMENTS

| | | | | |
|---|---|---|---|---|
| 208,797 | A | 10/1818 | Craig | |
| 1,054,754 | A | 3/1913 | Dawley | |
| 1,328,974 | A | 1/1920 | Thompson | |
| 2,239,727 | A | 4/1941 | Mayer | |
| 2,296,647 | A * | 9/1942 | McCormick | 91/306 |
| 3,019,735 | A | 2/1962 | Moeller | |
| 3,185,040 | A | 5/1965 | Ligon | |
| 3,283,752 | A * | 11/1966 | Stelzer | 123/46 R |
| 3,839,863 | A | 10/1974 | Frazier | |
| 3,853,036 | A | 12/1974 | Eskridge et al. | |
| 4,062,639 | A | 12/1977 | Conlee | |
| 4,087,205 | A | 5/1978 | Heintz | |
| 4,477,234 | A | 10/1984 | Roeder | |
| 4,478,560 | A | 10/1984 | Rupp | |
| 5,036,667 | A * | 8/1991 | Thatcher | 60/595 |
| 5,484,269 | A * | 1/1996 | Vick | 417/225 |
| 6,431,046 | B1 | 8/2002 | Okpokowuruk | |
| 7,237,470 | B2 * | 7/2007 | Burns, Sr. | 91/306 |

* cited by examiner

*Primary Examiner* — Charles G Freay
*Assistant Examiner* — Todd D Jacobs

(57) ABSTRACT

This invention is a reciprocating piston to piston device that can function 1) to increase or decrease pressure in a hydraulic or pneumatic system with minimal energy loss or 2) as a hydraulic or pneumatic pump or motor. The input and output fluids may be the same or different. The energy transferred or pumped depends on the size of the input piston, the pressure of the input fluid, and rate of reciprocation.

1 Claim, 13 Drawing Sheets

View of the Input Fluid Piston, the Two Output Fluid Pistons, and the Four Pilot Poppet Valves

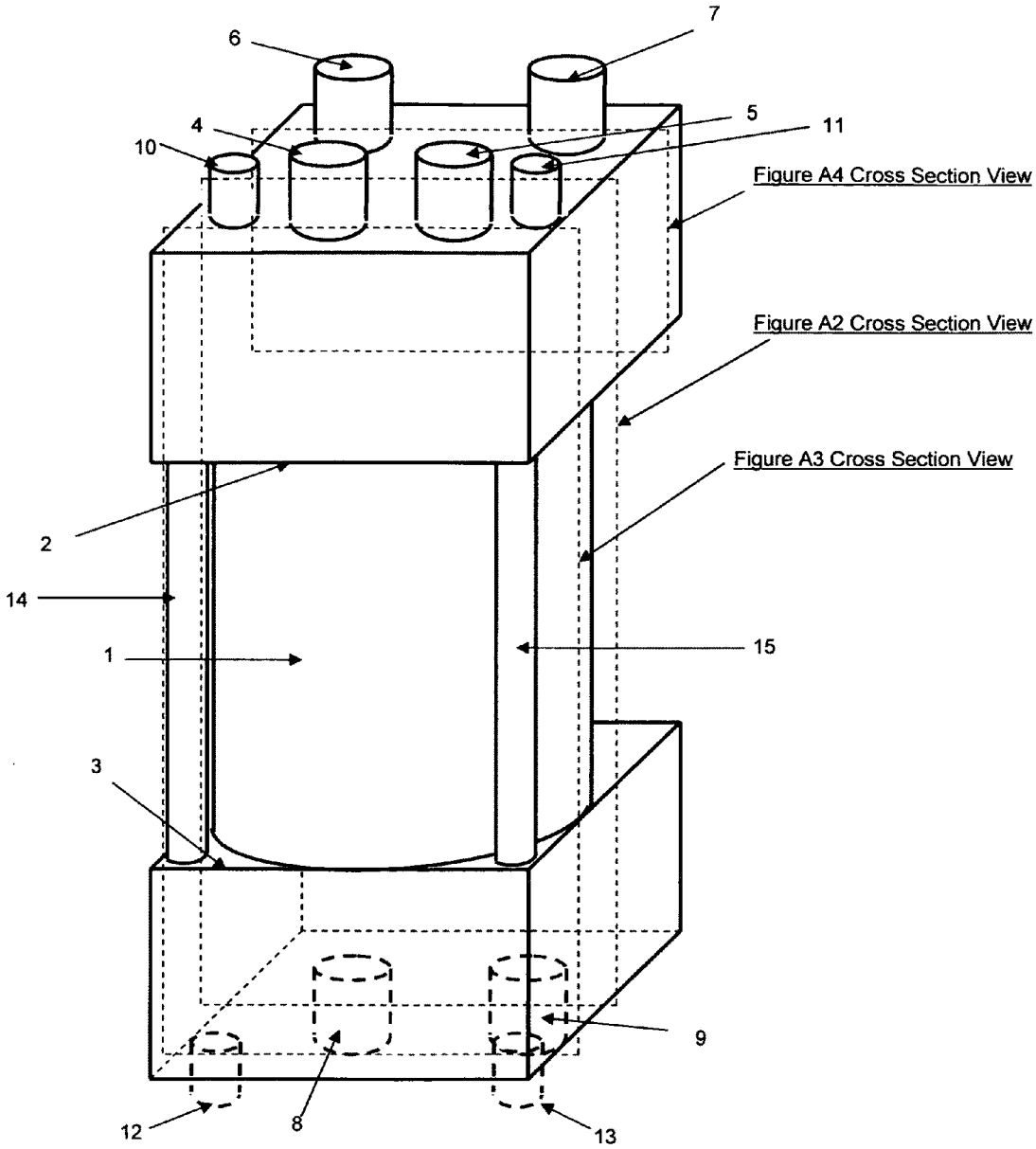
*Figure A1*: External View Of Major Components

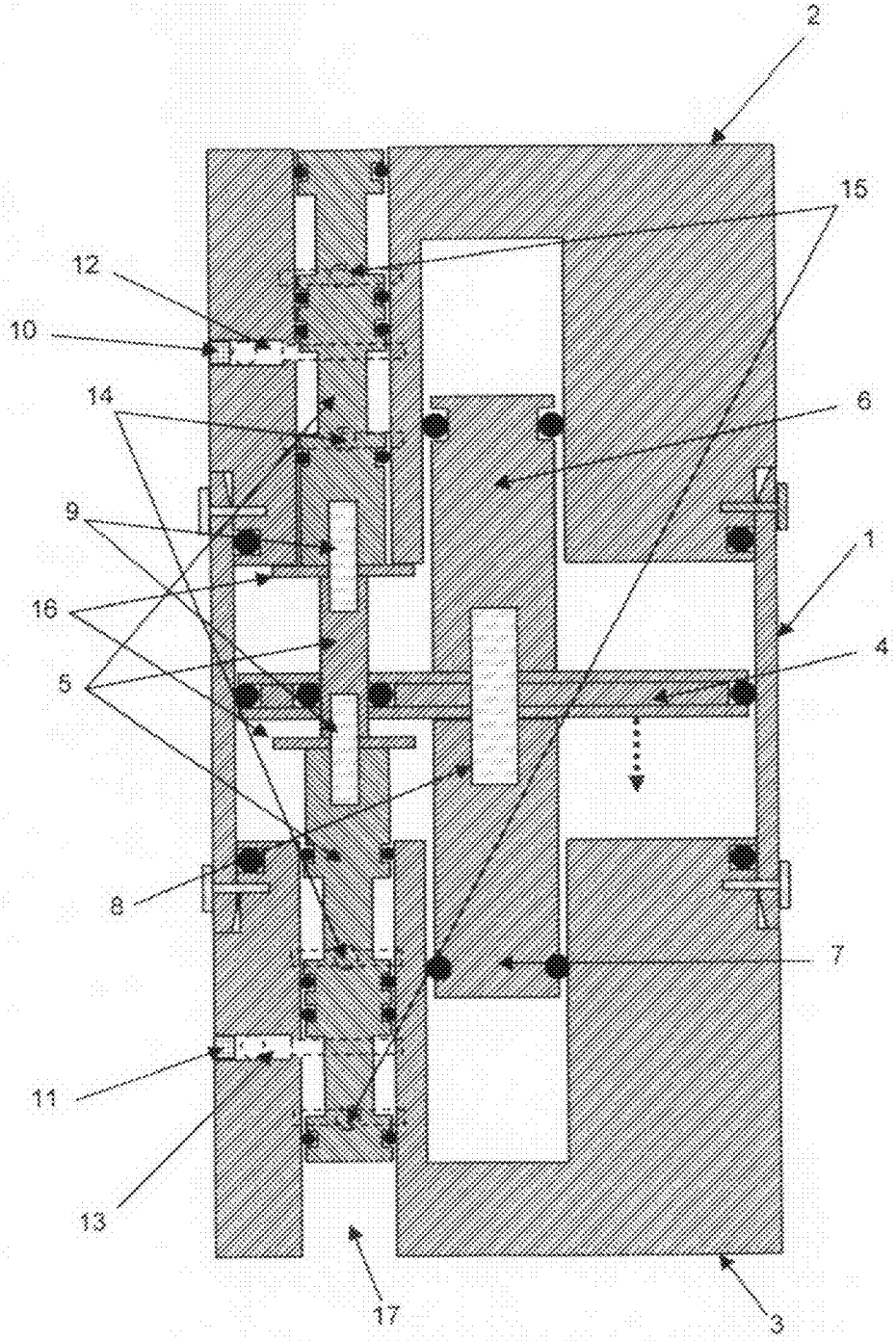
*Figure A2:* View of the Input Fluid Piston, the Two Output Fluid Pistons, and the Pilot Valve Assembly

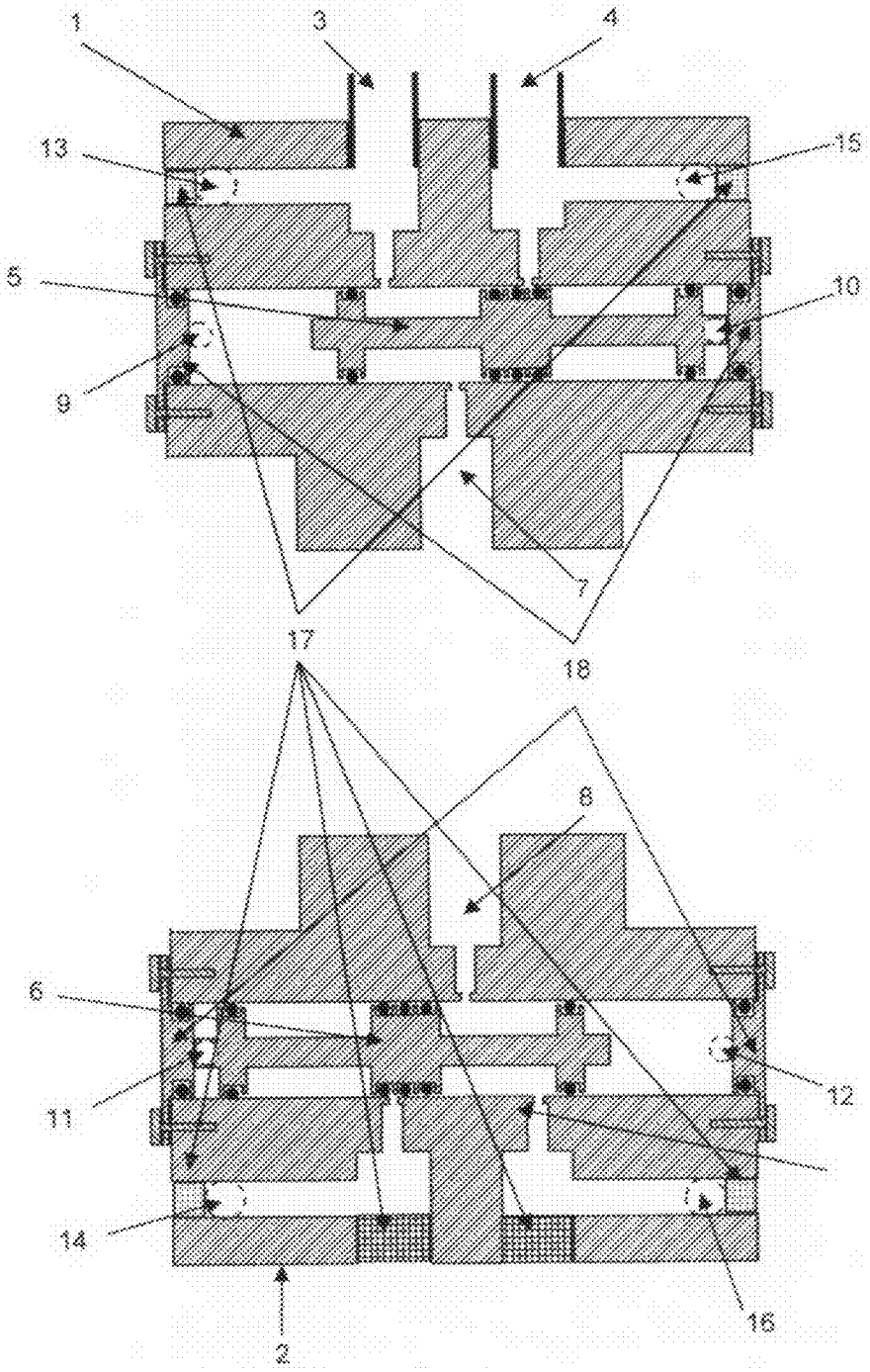
*Figure A3:* View of the Two Input Fluid Flow Slide Valves

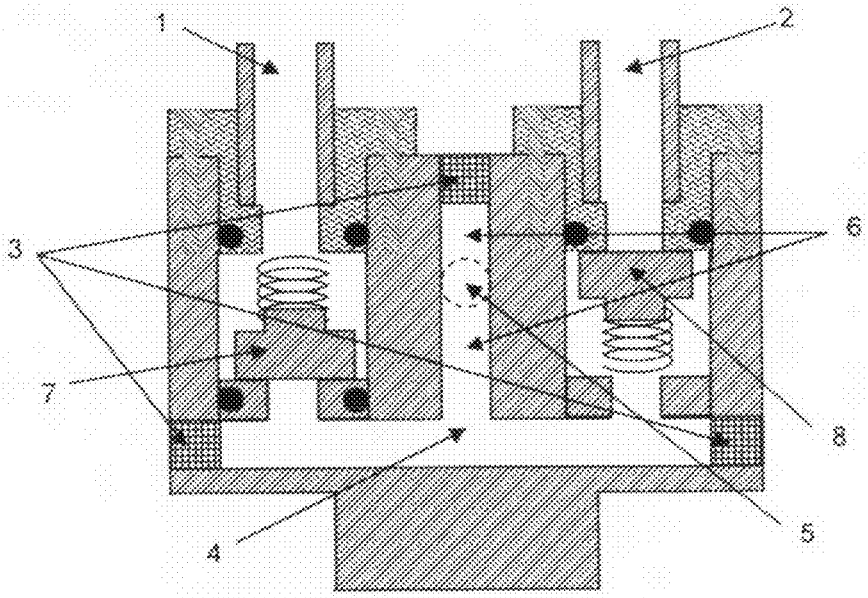
*Figure A4:* View of Output Fluid Check Valves

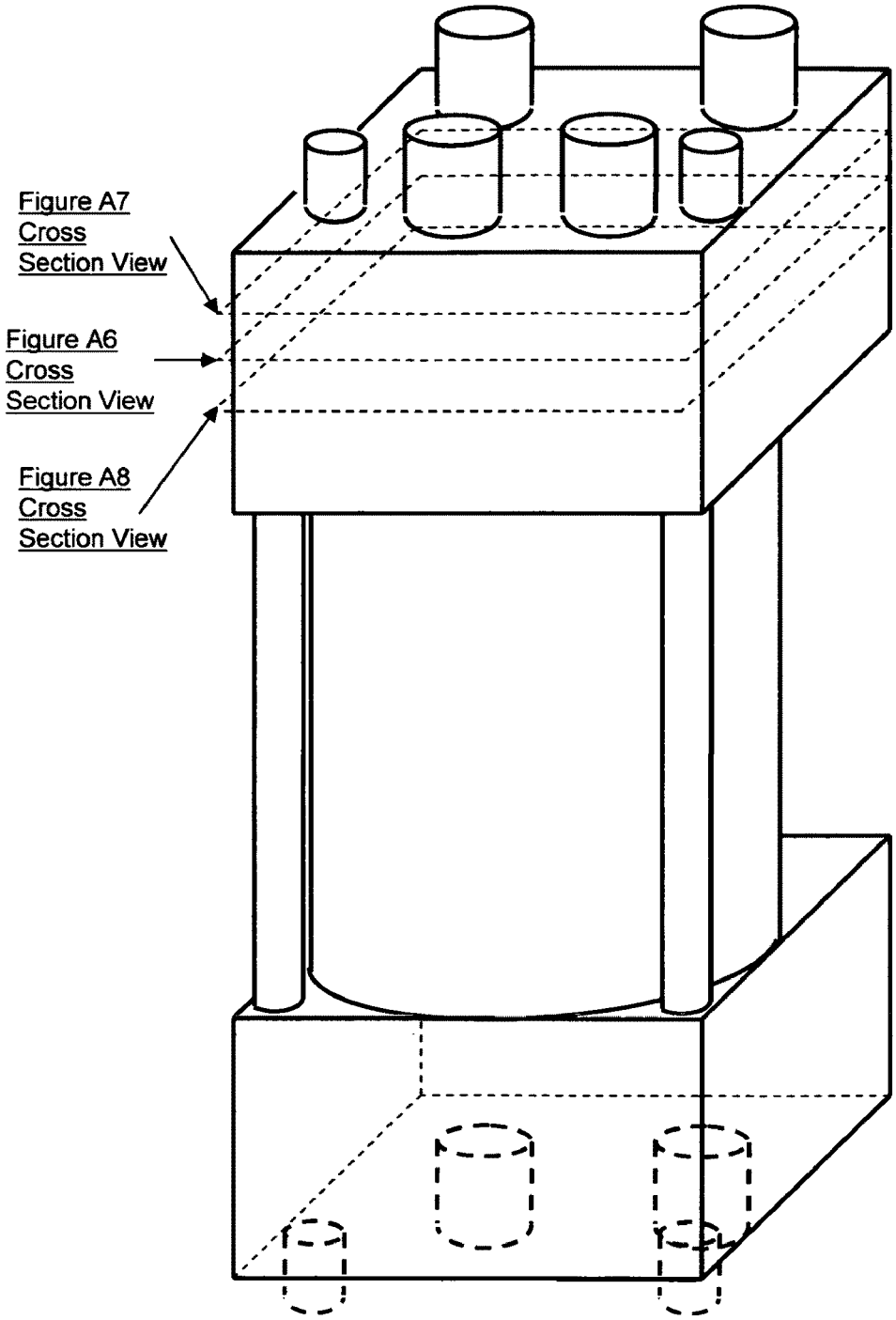
*Figure A5*: Location of the Cross Section of Figures 6, 7, and 8

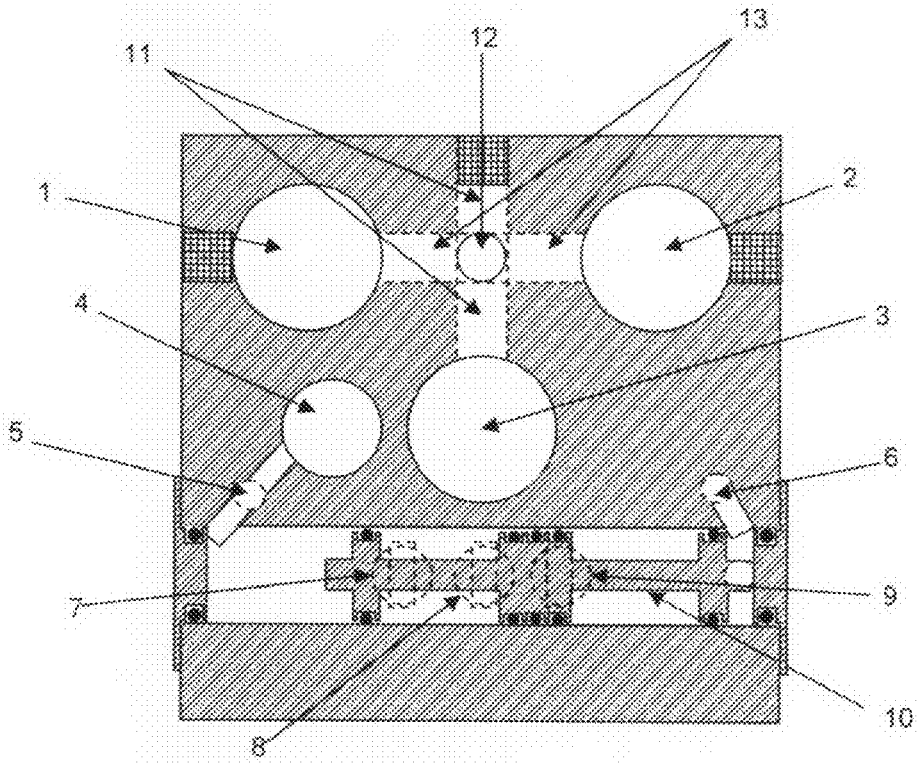
*Figure A6:* Cross Section View of Upper Block

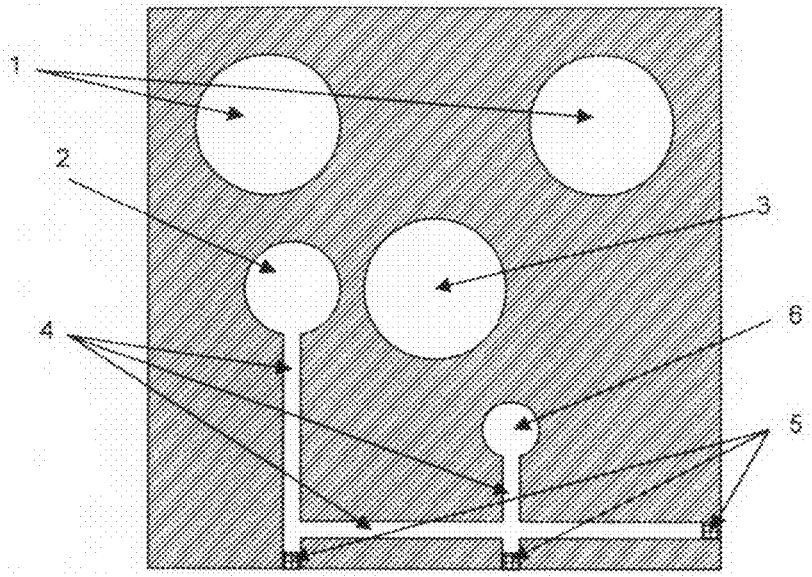
*Figure A7:* View of the Input Fluid Channel Between the Pilot Valve and the Input Fluid Outlet Port
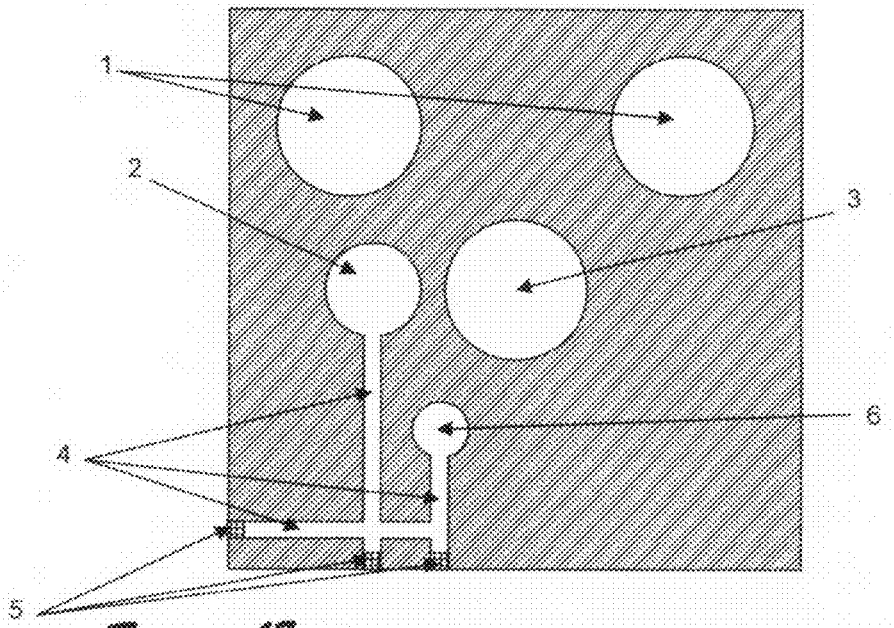
*Figure A8:* View of the Input Fluid Channel Between the Pilot Valve and the Input Fluid Inlet Port

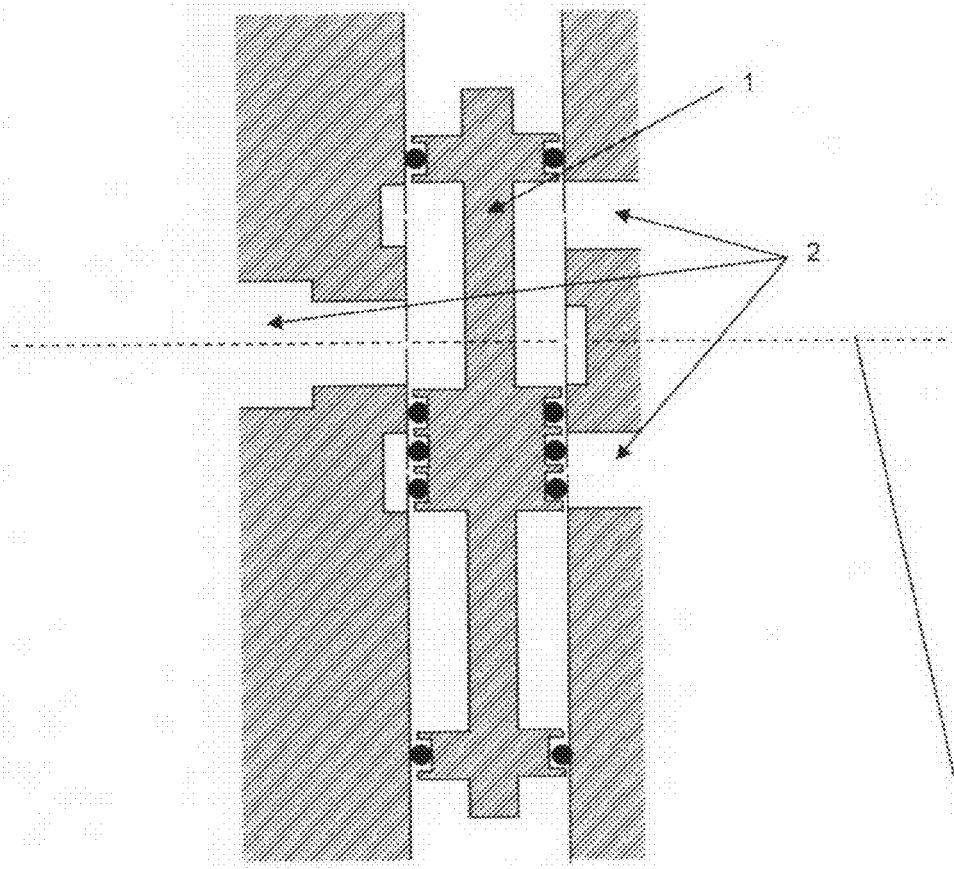
*Figure A9:* Detail Side View of a Slide Valve Port
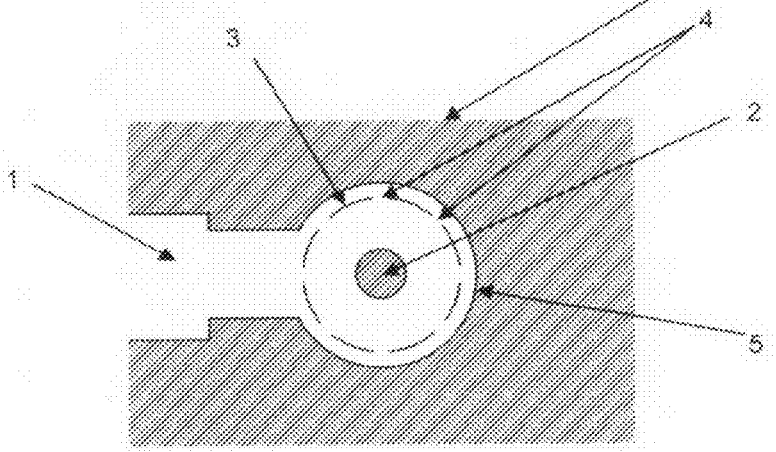
*Figure A10:* Detail End View of a Slide Valve Port

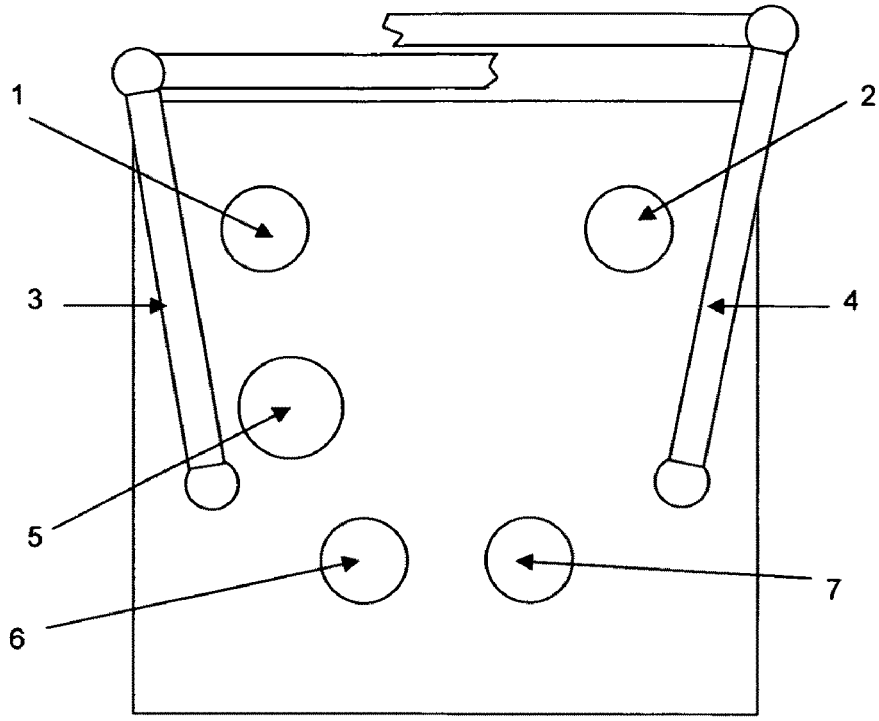
*Figure A11:* Top View of the Upper Block Showing Connections from the Left and Right Sides of the Upper Input Fluid Control Valve to the Opposite Sides of the Lower Input Fluid Control Valve

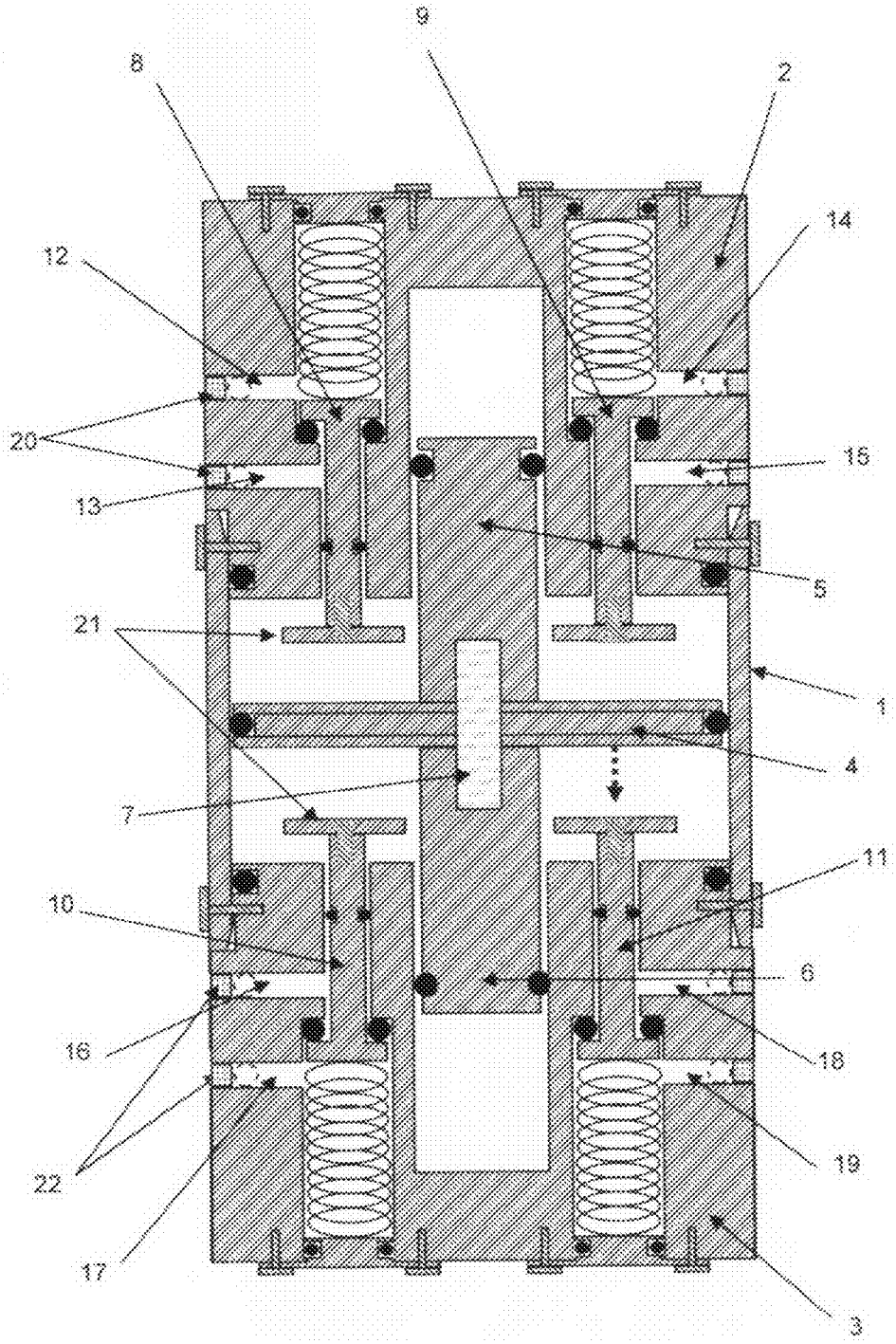
*Figure 31:* View of the Input Fluid Piston, the Two Output Fluid Pistons, and the Four Pilot Poppet Valves

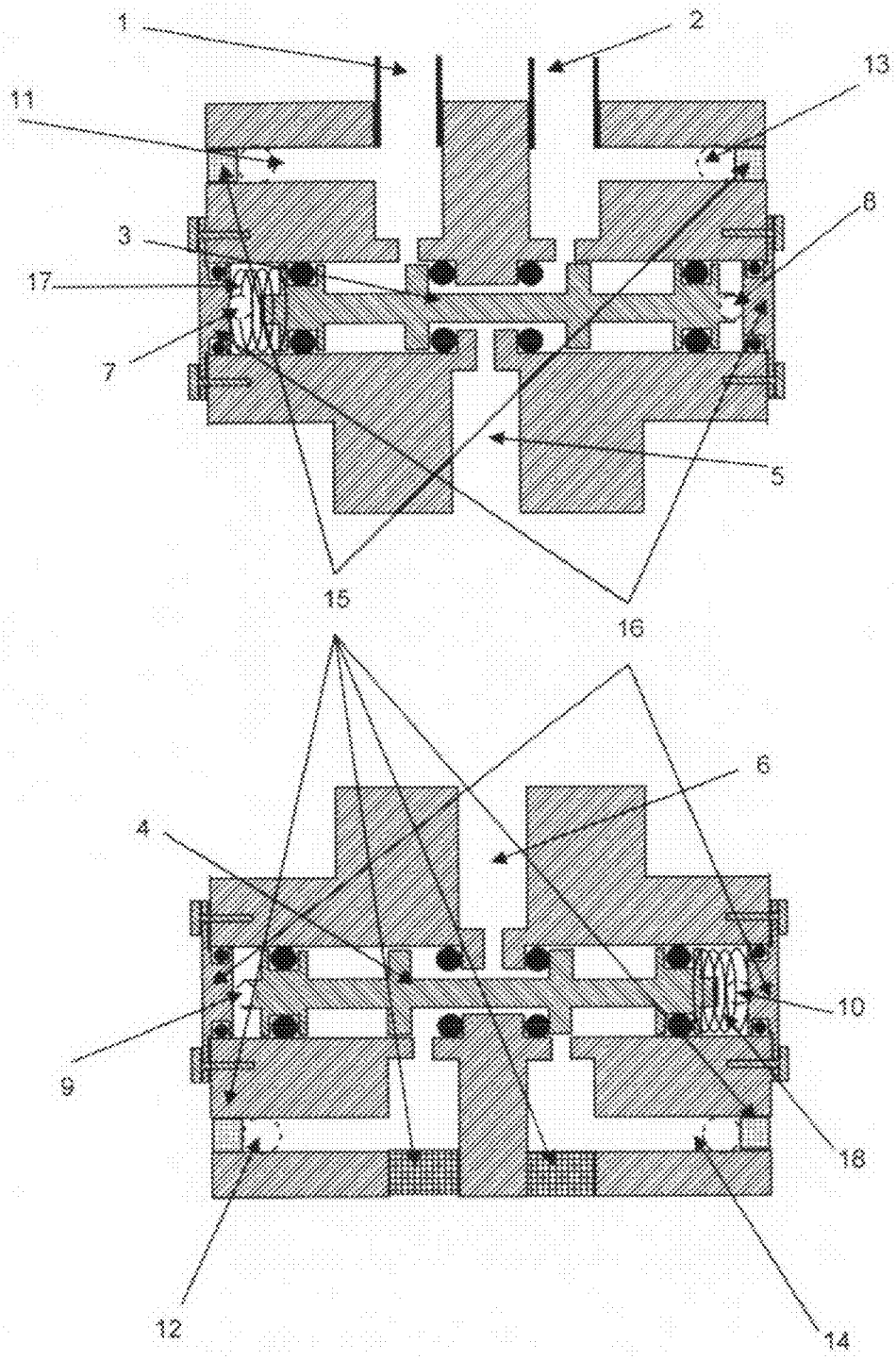
*Figure 82:* View of the Upper and Lower Input Fluid Control Poppet Valves

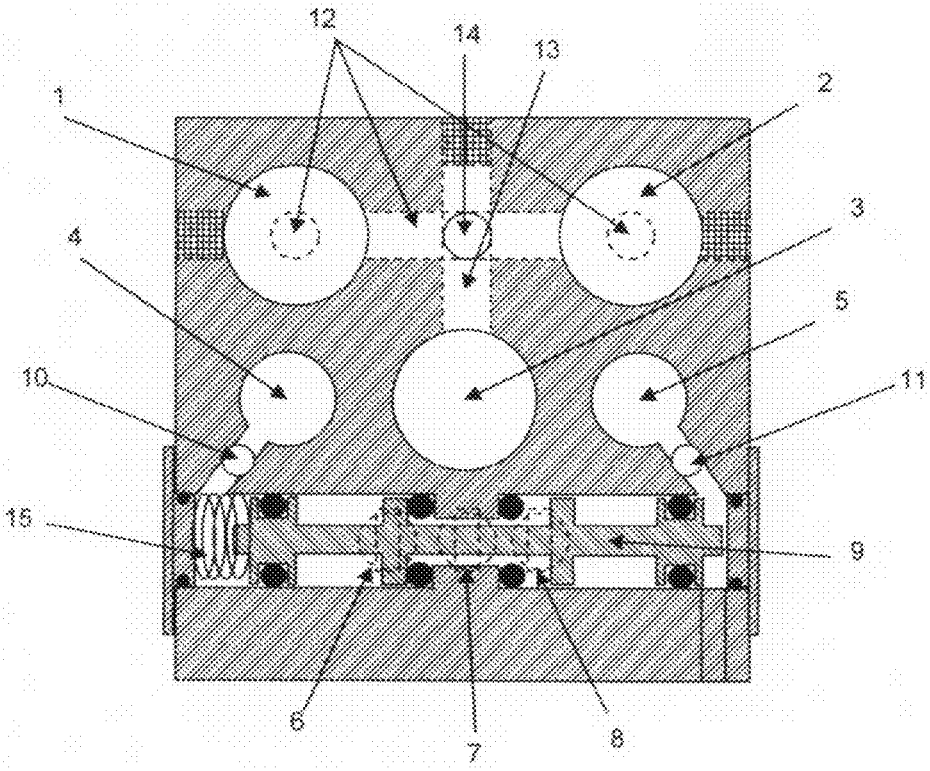
*Figure 33:* Cross Section View of Upper Block

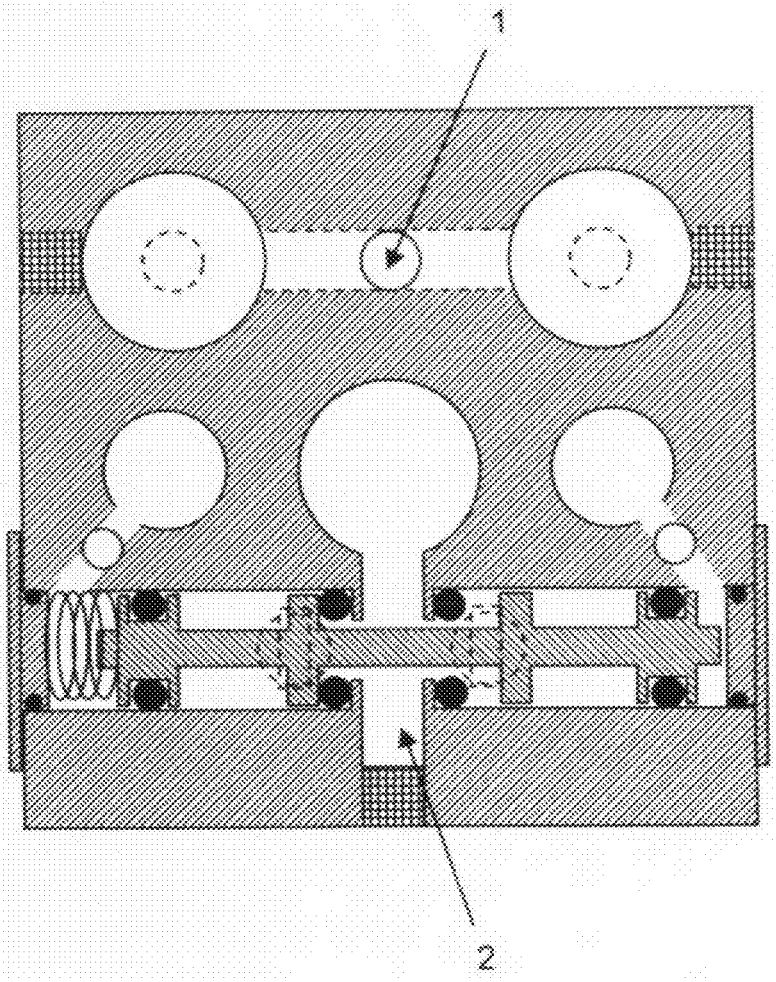
*Figure 21:* View of Upper Block

RECIPROCATING PISTON TO PISTON ENERGY PUMP

CROSS-REFERENCE TO RELATED APPLICATIONS

Not applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable

BACKGROUND OF INVENTION

The following is a tabulation of some prior art that presently appears relevant:

| U.S. Pat. No. | Issue Date | Patentee |
|---|---|---|
| 208,797 | Oct. 8, 1878 | Craig |
| 1,054,754 | Mar. 4, 1913 | Dawley |
| 1,328,974 | Jan. 27, 1920 | Thompson |
| 2,239,727 | Apr. 29, 1941 | Mayer |
| 2,296,647 | Feb. 28, 1941 | McCormick |
| 3,019,735 | Feb. 6, 1962 | Moeller and Scarff |
| 3,185,040 | Apr. 15, 1965 | Ligon |
| 3,839,863 | Oct. 8, 1974 | Frazier |
| 3,853,036 | Dec. 10, 1974 | Eskridge et al. |
| 4,062,639 | Dec. 13, 1977 | Conlee |
| 4,087,205 | May 2, 1978 | Heintz |
| 4,477,234 | Oct. 16, 1984 | Roeder |
| 4,478,560 | Oct. 23, 1984 | Rupp |
| 5,036,667 | Aug. 6, 1991 | Thatcher |
| 6,431,046 | Aug. 13, 2002 | Okpokowuruk |

This invention pertains to piston to piston reciprocating devices commonly used in pumps and engines. In this invention and the prior art reciprocating motion is achieved with the use of a pilot valve and a fluid input control valve. The fluid input control valve alternates the fluid in pressure between the two sides of the drive piston. As the drive piston nears the end of its motion the pilot valve is actuated which in turn switches the fluid input control valves thus reversing the motion of the drive piston achieving reciprocating motion. The drive piston is mechanically connected to an output piston which provides an output fluid at a different flow rate and pressure than that of the input fluid. As can be seen in the above referenced patents there are many way to interconnect these components.

The previous state of the art has resulted in devices a) designed for narrow specific applications,
b) that are bulky,
c) that are complicated and difficult to manufacture,
d) with valves that either wear out quickly or tend to leak,
e) that are difficult to miniaturize, and
f) that have a relatively low maximum operating speed.

BRIEF SUMMARY OF THE INVENTION

In accordance with multiple embodiments, this invention provides a) changes in the design of the pilot valves,
b) changes in the design of the control valves, and
c) the manner of connecting the pilot valve(s), master valve (s), and piston cylinders.

The device is a general purpose energy pump that can transform the pressure and rate of flow of an input fluid to a different pressure and rate of flow of an output fluid with minimal energy loss. Thus, it is a general purpose piston to piston reciprocating energy pump.

Advantages a) The design of the pilot and master valves provide for lower wear, faster piston reversing action, and smaller packaging.
b) Placing the valves and fluid channels within the cylinder blocks reduces the number of connectors, simplifies manufacture, and results in smaller packaging.
c) The design of the valves, pistons, and seals result in a pump that can run at a higher rate of reciprocation thus providing a higher energy throughput.
d) The design allows for easy miniaturization while maintaining or increasing the power to device volume ratio.

BRIEF DESCRIPTION OF THE SEVERAL VIEWS OF THE DRAWING

Note that in all of the drawings all seals are shown simply as black filled circles. The actual shape and composition of the seals will depend upon the materials pumped, the temperature of the materials pumped, and the pressures of the materials. Persons skilled in the art of piston devices will understand which type of seal to use.

Embodiment A

This embodiment shows all relevant detail of the Energy Pump.

FIG. A1 shows external perspective view of the major components.

FIG. A2 shows a view of the Input Fluid Piston, the two Output Fluid Pistons, and the Pilot Valve Assembly.

FIG. A3 shows a view of the two Input Fluid Control Slide Valves.

FIG. A4 shows a view of the Output Fluid Check Valves.

FIG. A5 is a perspective drawing showing the location of the cross section views of FIGS. 6, 7, and 8.

FIG. A6 shows a cross section view of the Upper Block.

FIG. A7 shows a cross section view of the Input Fluid Channel between the Pilot Valve and Input Fluid Outlet Port.

FIG. A8 shows a cross section view of the Input Fluid Channel between the Pilot Valve and the Input Fluid Inlet Port.

FIG. A9 shows a detail side cross section view of a Slide Valve Port. This detail applies to all slide valves.

FIG. A10 shows a detail end cross section view of a Slide Valve Port. This detail applies to all slide valves.

FIG. A11 shows a top view of the Upper Block showing the connections from the left and right sides of the Upper Input Fluid Control Valve to the opposite sides of the Lower Input Fluid Control Valve.

Embodiment B

This embodiment shows an alternate design replacing the slide valves for poppet valves. Only the changes are shown in the figures.

FIG. B1 shows a cross section view of the Input Fluid Piston, the two Output Fluid Pistons, and the four Pilot Poppet Valves.

FIG. B2 shows a cross section view of the Upper and Lower Input Fluid Poppet Valves.

FIG. B3 shows a cross section view of the Upper Block

Embodiment C

In Embodiments A and B the drawings imply that the output fluid pressure will be greater than the input fluid pressure and that the output fluid flow will less than the input fluid flow rate. Embodiment C shows a simple modification in the fluid channels that reverses the function of the input fluid and output fluid pistons. Consequently, in embodiment C the output fluid pressure is less than the output fluid pressure and the output fluid flow rate is greater than the input fluid flow rate.

FIG. C1 shows a view of the Upper Block showing only the two modifications required. The same two modifications are required in the Lower Block.

DETAILED DESCRIPTION OF THE INVENTION

Embodiment A

FIGS. A1 through A9

One embodiment of the Piston to Piston Energy Pump is illustrated in FIGS. A1 through A9.

FIG. A1 shows that an external perspective view of the energy pump. This figure shows:

1. The Cylinder Housing. This cylinder contains the drive piston shown in later figures.
2. The Upper Block. This block contains valves and various external connections. In this embodiment input fluid enters into and exits the Energy Pump from the Upper Block only.
3. The Lower Block. This block contains valves and various external connections.
4. The Input Fluid Inlet Port.
5. The Input Fluid Outlet Port.
6. The Upper Block Output Fluid Outlet Port
7. The Upper Block Output Fluid Inlet Port.
8. The Lower Block Output Fluid Outlet Port
9. The Lower Block Output Fluid Inlet Port.
10. Port that connects the left side of the Upper Input Fluid Valve Control Assembly with the right side of the Lower Input Valve Control Assembly via Port #13. The tubing that connects these ports is not shown in figure. The Input Fluid Control Valve Assemblies are sown in later figures.
11. Port that connects the right side of the Upper Input Fluid Valve Control Assembly with the left side of the Lower Input Valve Control Assembly via Port #12. The tubing that connects these ports is not shown in figure.
12. Port that connects the left side of the Lower Input Fluid Valve Control Assembly with the right side of the Upper Input Valve Control Assembly via Port #11. The tubing that connects these ports is not shown in figure.
13. Port that connects the right side of the Lower Input Fluid Valve Control Assembly with the left side of the Upper Input Valve Control Assembly via Port #10. The tubing that connects these ports is not shown in figure.
14. Input Fluid Channel Connecting Upper and Lower Block Input Fluid Inlet Channels.
15. Input Fluid Channel Connecting Upper and Lower Block Input Fluid Outlet Channels.

A rearrangement of the fluid channels could easily connect the Output Fluid Inlet Outlet Ports such that there is only a single Output Fluid Inlet Port and a single Output Fluid Outlet Port. Similarly the single Input Fluid Inlet and Outlet Ports could be divided into a pair of each.

FIG. A1 also shows the locations of the cross sections of FIGS. 2, 3, and 4.

FIG. A2 shows a vertical cross section through the middle of the drawing of FIG. A1 parallel to the plane of the paper of the drawing. This cross section shows:

1. The Cylinder Housing.
2. The Upper Block.
3. The Lower Block.
4. Input Fluid Drive Piston or Middle Piston. The said piston is moving in the downward direction.
5. The Pilot Valve Assembly. The Pilot Valve Assembly is shown in the position consistent with the Input Fluid Drive Piston moving in a downward direction.
6. The Upper Fluid Out Piston
7. The Lower Fluid Out Piston
8. A treaded rod securing the Upper and Lower Fluid Out Pistons to Fluid In Drive Piston.
9. Treaded rods securing Pilot Valve Assembly.
10. A sealing plug.
11. A sealing plug.
12. Fluid Channel Leading to Left End of Upper Input Fluid Control Valve Cylinder and Right End of Lower Input Fluid Control Valve Cylinder.
13. Fluid Channel Leading to Right End of Upper Input Fluid Control Valve Cylinder and Left End of Lower Input Fluid Control Valve Cylinder.
14. Fluid Channel from Input Fluid Pressure Inlet Port.
15. Fluid Channel to Input Fluid Outlet Port.
16. Damping Plates to reduce wear.
17. Lower Block Pilot Valve Cylinder.

The reader should note that:

a) The upper end of the Pilot Valve Assembly (#5) is contained in a cylinder with three fluid channels; one channel (#14) takes fluid under pressure from the Input Fluid Inlet Port, the second (#15) channel delivers fluid to the Input Fluid Outlet Port and the third channel (#13) delivers fluid to or removes fluid from the Input Fluid Control Valves (FIG. A3).

b) The upper end of the Pilot Valve Assembly is shown in the position where it delivers input fluid pressure to the Fluid Control Valves (FIG. A3).

c) The lower end of the Pilot Valve Assembly in the Lower Block is shown in the position where it removes input fluid pressure from the Fluid Control Valves (FIG. A3) via the Input Fluid Outlet Port.

d) The Input Fluid Drive Piston (#4) is shown as moving in the downward direction which is consistent with the Pilot Valve Assembly (#5) position, and, as will be seen in FIG. A3, is consistent with the positions of the Input Fluid Control Valves. The Input Fluid Drive Piston (#4) is moving downward because the upper chamber of the cylinder housing is under pressure from the input fluid entering the Energy Pump. The lower chamber of the Cylinder Housing is at low pressure. The reason for this will be clear in FIG. A3.

e) As the Input Fluid Drive Piston moves down it will engage the Pilot Valve Assembly (#5) changing the flow of input fluid to the Input Fluid Control Valves. It is important to realize that the changing of the position of the Pilot Valve Assembly (#5) does not directly affect the flow of fluid in or out of the Cylinder (#1) Chambers, and thus does not directly alter the movement of the Input Fluid Drive Piston (#4). The importance of this will be apparent in FIG. A3.

FIG. A3 is a cross section parallel to the cross section of FIG. A2. It is forward of FIG. A2 as indicated in the perspective drawing of FIG. A1. This cross section shows:

1. The Upper Block
2. The Lower Block
3. Input Fluid Inlet Port
4. Input Fluid Outlet Port
5. Upper Input Fluid Control Valve Assembly
6. Lower Input Fluid Control Valve Assembly
7. Upper Input Fluid Port to Upper Drive Piston Chamber
8. Lower Input Fluid Port to Lower Drive Piston Chamber
9. Inlet from Upper End of Pilot Valve #12 in FIG. A2.
10. Inlet from Lower End of Pilot Valve #13 in FIG. A2.
11. Inlet from Lower End of Pilot Valve #13 in FIG. A2.
12. Inlet from Upper end of Pilot Valve #12 in FIG. A2.
13. Input Fluid Inlet Pressure Channel
14. Input Fluid Inlet Pressure Channel
15. Input Fluid Outlet Return Channel
16. Input Fluid Outlet Return Channel
17. Sealing Plugs
18. Sealing End Caps The reader should note:

a) The Input Fluid Slide Control Valves (#5 and #6) are in the position such that input fluid pressure is applied to the Upper Cylinder Chamber and input fluid is flowing out of the Lower Cylinder Chamber.

b) The Cylinder and the Input Fluid Piston are NOT shown in FIG. A3.

c) The Fluid Input Piston will engage the Pilot Valve Assembly when it has traveled down far enough. When said engagement occurs the fluid into the Upper Chamber of the Cylinder Housing will not be affected.

d) Once the Pilot Valve Assembly has been moved far enough the pressure on the left side of the Upper Input Fluid Slide Control Valve (#5) and the pressure on the right side of the Lower Input Fluid Slide Control Valve (#6) will be released. At the same time fluid in pressure will be applied to the opposite sides of both of these valves. Once this process has started it no longer matters what the Input Fluid Piston is doing, the process of switching the valves will continue. Once the Input Fluid Control Valves have moved far enough the flow of fluid into the upper chamber of the cylinder will stop and the pressure will be released in this chamber. At the same time the pressure in the lower chamber of the cylinder will be increased and the Input Fluid Piston will change direction and start moving upwards, thus achieving reciprocating motion.

FIG. A4 shows a cross section view of the Output Fluid Check Valves. It is a vertical cross section parallel to the plane of FIG. A1 and shown in FIG. A1. This cross section shows:

1. The Output Fluid Pressure Outlet Port
2. The Output Fluid Inlet Port
3. Sealing Plugs.
4. The output fluid channel from the Output Fluid Check Valves.
5. The output fluid channel from end of Output Fluid Cylinder.
6. The output fluid channel connecting fluid channels #4 and #5.
7. The Output Fluid Outlet Check Valve.
8. The Output Fluid Inlet Check Valve.

FIG. A5 shows the locations of the cross sections of FIGS. 6, 7, and 8.

FIG. A6 shows a cross section of the upper block parallel to the top of the Energy Pump as shown in FIG. A5. This cross section shows:

1. The hole for inserting Output Fluid Pressure Outlet Check Valve.
2. The hole for inserting Output Fluid Inlet Check Valve.
3. The Output Fluid Piston Cylinder.
4. The Pilot Valve Cylinder.
5. The input fluid channel leading from Upper Pilot Valve to the Left End of the Upper Input Fluid Control Valve and the right end of the Lower Input Fluid Control Valve.
6. The input fluid channel from Lower Pilot Valve.
7. The input fluid channel between the Input Fluid Inlet Port and the Input Fluid Control Valve.
8. The input fluid channel to Upper End of Cylinder Housing.
9. The input fluid channel for fluid return to the Input Fluid Outlet Port.
10. The Upper Input Fluid Control Slide Valve Assembly.
11. The output fluid channel from the top of the Upper Output Fluid Piston.
12. The output fluid channel leading from fluid channel #11 to fluid channel #13.
13. The output fluid channel leading from fluid channel #12 to the bottom of each of the Output Fluid Check Valves.

Note that the Upper Input Fluid Control Slide Valve is positioned to provide input fluid pressure into the Upper Chamber of the Input Fluid Cylinder consisted with the other figures.

FIG. A7 shows a cross section of the upper block parallel to the top of the Energy Pump as shown in FIG. A5. This cross section shows:

1. The holes for Outlet Check Valves.
2. The Pilot Valve Cylinder.
3. The cylinder for the Output Fluid Piston.
4. The input fluid outlet channels.
5. Sealing plugs.
6. The Input Fluid Outlet Port.

FIG. A8 shows a cross section of the upper block parallel to the top of the Energy Pump as shown in FIG. A5. This cross section shows:

1. The holes for Outlet Check Valves.
2. The Pilot Valve Cylinder.
3. The cylinder for the Output Fluid Piston.
4. The input fluid inlet pressure channels.
5. Sealing plugs.
6. The Input Fluid Inlet Pressure Port FIG. A9 shows an enlarged cross section of a side view of one of the slide valve ports. The conventional slide valve has a single hole side port. In this invention there are multiple small side holes that lead to a single fluid channel. This allows a shorter stroke to switch the valve resulting in faster slide valve operation. The smaller holes also reduce wear on the slide valve seals. FIG. A9 shows:

1. The Slide Valve.
2. The Side Ports.

FIG. A10 shows an enlarged cross section of an end view of one of the slide valve ports. The figure shows:

1. A Side Port.
2. A cross section of the narrow portion of the Slide Valve.
3. The cylinder within which the Slide Valve operates.
4. The multiple small holes around the Slide Valve Cylinder.
5. The outer housing around the Slide Valve Cylinder to Direct Fluid to or from the Side Port.

FIG. A11 is a top view of the Upper Block. This Figure shows two fluid channel connections. These channels are external to the Upper and Lower Block. They connect opposite ends of the Upper Input Fluid Control Valve and the Lower Input Fluid Control Valve. FIG. A11 shows:

1. The Output Fluid Inlet Port.
2. The Output Fluid Outlet Port.
3. The external to Block Fluid Channels connecting the left side of the Upper Input Fluid Control Valve to the right side of the Lower Input Fluid Control Valve.
4. The external to Block Fluid Channels connecting the right side of the Upper Input Fluid Control Valve to the left side of the Lower Input Fluid Control Valve.
5. The Pilot Valve Assembly Chamber.
6. The Input Fluid Inlet Port.
7. The Input Fluid Outlet Port.

Embodiment B

FIGS. B1 through B3

Embodiment B replaces the slide valves of Embodiment A with poppet valves. The figures and description of Embodiment B only show changes from Embodiment A.

FIG. B1 shows a cross section in the same location as FIG. A2. This cross section shows four Pilot Poppet Valves (#8, #9, #10, and #11) replacing the prior Pilot Valve Assembly of FIG. A2. The four Pilot Poppet (#8, #9, #10, and #11) Valves perform exactly the same function as the Pilot Valve Assembly of FIG. A2.

FIG. B2 shows the following components.

1. Cylinder Housing.
2. Upper Block.
3. Lower Block.
4. Fluid In Drive Piston.
5. Upper Fluid Out Piston.
6. Lower Fluid Out Piston.
7. A treaded rod securing Upper and Lower Fluid Out Pistons to Fluid In Drive Piston.
8. Upper Left Poppet Valve.
9. Upper Right Poppet Valve.
10. Lower Left Poppet Valve.
11. Lower Right Poppet Valve.
12. The Fluid Channel to the Left End of the Upper Input Fluid Control Valve Cylinder and to the Right End of the Lower Input Fluid Control Valve Cylinder.
13. The Fluid Channel from Input Fluid Inlet Pressure Port.
14. The Fluid Channel to the Right End of the Upper Input Fluid Control Valve Cylinder and to the Left End of the Lower Input Fluid Control Valve Cylinder.
15. The Fluid Channel to the Input Fluid Outlet Port.
16. The Fluid Channel from the Input Fluid Inlet Pressure Port.
17. The Fluid Channel to the Left End of the Lower Input Fluid Control Valve Cylinder and to the Right End of the Upper Input Fluid Control Valve Cylinder.
18. The Fluid Channel from the Input Fluid Outlet Port.
19. The Fluid Channel to the Right End of the Lower Input Fluid Control Valve Cylinder and to the Left End of the Upper Input Fluid Control Valve Cylinder.
20. Sealing Plugs.
21. Damping Plates to reduce wear rate.
22. Sealing Plugs.

FIG. B2 shows the Upper and Lower Input Fluid Control Valves replaced with Upper and Lower Input Fluid Control Poppet Valves (#3 and #4). The slide valves of FIG. A3 and poppet valves of FIG. B2 perform exactly the same function.

FIG. B2 shows the following components.

1. The Input Fluid Pressure Inlet Port.
2. The Input Fluid Outlet Port.
3. The Upper Input Fluid Control Valve Assembly.
4. The Lower Input Fluid Control Valve Assembly.
5. The Upper Input Fluid Port to Upper Drive Piston Chamber.
6. The Lower Input Fluid Port to Lower Drive Piston Chamber.
7. The Inlet Channel from Upper Left Pilot Poppet Valve and Lower Right Pilot poppet Valve.
8. The inlet from Upper Right Pilot Poppet Valve and Lower Left Pilot Poppet Valve.
9. The from Upper Right Pilot Poppet Valve and Lower Left Pilot Poppet Valve.
10. The inlet from Upper Left Pilot Poppet Valve and Lower Right Pilot Poppet Valve.
11. The Input Fluid Inlet Pressure Channel.
12. The Input Fluid Inlet Pressure Channel.
13. The Input Fluid Outlet Channel.
14. The Input Fluid Outlet Channel.
15. Sealing Plugs.
16. Sealing End Caps.
17. The Upper Input Control Poppet Valve Spring to Place the Upper Input Control Poppet Valve in the start position.
18. The Lower Input Control Poppet Valve Spring to Place the Lower Input Control Poppet Valve in the start position.

FIG. B3, Cross Section View of Upper Block, shows the same cross section view of the Upper Block as seen in FIG. A6. This figure shows:

1. The hole for Inserting Output Fluid Pressure Out Check Valve.
2. The hole for Inserting Output Fluid Intake Check Valve.
3. The Output Fluid Piston Cylinder.
4. The hole for the Upper Left Input Fluid Pilot Poppet Valve.
5. The hole for the Upper Right Input Fluid Pilot Poppet Valve.
6. The input fluid channel to the Input Fluid Inlet Pressure Port.
7. The input fluid channel to Upper End of Cylinder Housing.
8. The input fluid channel for Fluid Return to the Input Fluid Outlet Port.
9. The Upper Input Fluid Control Poppet Valve Assembly.
10. The input fluid channel to the Lower Right Pilot Poppet Cylinder.
11. The input fluid channel to the Lower Left Pilot Poppet Cylinder.
12. The output fluid channel below the Output Fluid Check Valves.
13. The output fluid channel from the top of Output Fluid Upper Cylinder.
14. The output fluid channel connecting the output fluid channels #12 and #13.
15. Spring to Place the Upper Input Control Poppet Valve in the Start Position. Note the spring for the Lower Input Control Poppet Valve is on the right side.

Embodiment C

FIG. C1

Embodiments A and B show designs with the energy pump acting as a pressure increaser. Embodiment C shows a simple design change that allows the energy pump to act as a pressure reducer. In this case the input fluid pressure is greater than the output fluid pressure and correspondingly the output fluid flow rate is greater than the input fluid flow rate. The figure and description of Embodiment C only shows changes from Embodiment B. Although embodiment C shows the use of poppet valves it could just as easily use the slide valves of Embodiment A.

FIG. C1 shows the function of the pistons reversed. The larger piston in the Central Cylinder has become the Output Fluid Piston and the Upper and Lower Pistons have become the Input Fluid Pistons. The change that accomplished this is shown in FIG. C1. The cross section view is the same as in FIG. B3. Fluid channels #7 and #13 of FIG. B3 have been replaced with fluid channels #1 and #2 of FIG. C1. The new fluid channels are described as follows.

1. The Fluid Channel into upper section of Cylinder Housing.
2. The Fluid Channel from Input Fluid Control Valve to Upper End of the Upper Block Piston Housing.

A Note about the Fluid Channels in All Embodiments

In all embodiments all fluid channels between the valves and the piston cylinders are cut within the upper and lower blocks with four exceptions. Those exceptions are the interconnection of a) the Input Fluid Inlet Port in the Upper Block and the input fluid inlet channels in the Lower Block,
b) the Input Fluid Outlet Port in the Upper Block and the input fluid outlet channels in the Bottom Block,
c) the fluid channel between the right side of the Upper Input Fluid Control Valve and the left side of the Lower Input Fluid Control Valve, and
d) the fluid channel between the left side of the Upper Input Fluid Control Valve and the right side of the Lower Input Fluid Control Valve.

Operation of All Embodiments

There are no on-off or start switches. To operate the energy pump one connects the Output Fluid Inlet Port to a reservoir of output fluid and connects the Input Fluid Inlet Port to a source of input fluid under pressure. The Energy Pump will immediately start operating. Output fluid at pressure will appear at the Output Fluid Outlet Port and input fluid will be discharged at the Input Fluid Outlet Port.

Note that the Energy Pump only pumps on demand. If the outlet port of the output fluid is connected to some hydraulically driven equipment and that equipment is not performing work then the energy pump will automatically stop with the input fluid pressure balanced against the output fluid pressure given the ratio of the input fluid piston and the output fluid piston. When the hydraulic equipment connected to the Output Fluid Outlet Port is used the pump will start pumping automatically.

Advantages

From the description above, a number of advantages of my Energy Pump will be evident:

a) The design wherein the valves and most of the fluid channels are contained within the Lower and Upper Blocks makes for a very compact device.
b) Despite its small size my Energy Pump can handle a significant power level. The energy is limited only by the rate of reciprocation and the tensile strength of the materials. If the input fluid is hot then radiating the heat will also be a limitation.
c) The Energy Pump is very scalable. It is easier to miniaturize than other piston to piston pumps, because most of the fluid channels are internal in the blocks. The principle miniaturization limitations are the external block connections.
d) In current pressurized systems if a lower pressure is desired a pressure reducing valve is used. Such devices are very energy inefficient. The Energy Pump can be used to reduce pressure with a corresponding increase in fluid flow rate thus loosing very little energy.
e) Other than valves the Energy Pump has only a single moving part, which makes it highly reliable.
f) Most any fluid at any pressure and temperature can be used with only a change in seals as appropriate.
g) The Energy Pump is simple in construction making it easy to manufacture.
h) Changing it from a device that increases pressure to one that reduces pressure requires only a small modification in manufacturing.

CONCLUSIONS, RAMIFICATIONS, AND SCOPE

Accordingly the reader will see that the Energy Pump can be used in two broad application categories. 1) It can be used in hydraulic and pneumatic systems to increase or reduce pressure with very minimal energy loss. 2) It can be used as a hydraulic pump or motor or as a pneumatic pump or motor with input from a variety of sources.

The following is a partial list of potential sources of input fluids for the Energy Pump when used as a hydraulic pump or motor.

a) Compresses Air
b) Combustion Gases Under Pressure from Virtually any Source
c) Steam
d) Monopropellants such as Hydrogen Peroxide and Hydrazine While the above description contains much specificity, these should not be construed as limitations on the scope of any embodiment, but as exemplifications of various embodiments thereof. Many other ramifications and variations are possible within the teachings of the embodiments.

Thus the scope should be determined by the appended claims and their legal equivalents, and not by the examples given.

I claim:

1. A device consisting of a) three directly connected pistons, including an upper piston, middle piston, and lower piston, the diameters of said upper and said lower pistons are equal and said upper and lower piston diameters are less than the diameter of said middle piston,
b) cylinder chambers for each of the said pistons,
c) two input fluid control valves, that control the input fluid to either the said middle piston or the said upper and lower pistons,
d) one of a pilot valve assembly and a set of four pilot valves that control input fluid to the said input fluid control valves,
e) four check valves to control the direction of output fluid flow,
f) an upper block that contains said upper piston, said upper piston cylinder chamber, one of said input fluid control valves, two of the said output fluid check valves, either the said upper half of the said pilot valve assembly or two of said pilot valves, and a set of fluid channels that interconnect:
   i) said upper piston cylinder chamber,
   ii) said input fluid control valve,
   iii) the said two output fluid check valves, and
   iv) either the said upper half of the pilot valve assembly or the said two pilot valves, and g) a lower block that contains said lower piston, said lower piston cylinder chamber, one of said input fluid control valves, the two output fluid check valves, either the said lower half of the pilot valve assembly or two of the said pilot valves, and a set of fluid channels that interconnect:
   i) said lower piston cylinder chamber,
   ii) said input fluid control valve,
   iii) the said two output fluid check valves, and
   iv) either the said lower half of the pilot valve assembly or the said two pilot valves.

* * * * *